US009221595B2

(12) United States Patent
Boyne

(10) Patent No.: US 9,221,595 B2
(45) Date of Patent: Dec. 29, 2015

(54) SPRAY DEVICE

(76) Inventor: Candice Alice Boyne, Los Angeles, CA (US)

( * ) Notice: Subject to any disclaimer, the term of this patent is extended or adjusted under 35 U.S.C. 154(b) by 138 days.

(21) Appl. No.: 13/064,678

(22) Filed: Apr. 6, 2011

(65) Prior Publication Data

US 2014/0199248 A1 Jul. 17, 2014

Related U.S. Application Data

(60) Provisional application No. 61/322,786, filed on Apr. 9, 2010.

(51) Int. Cl.

| | |
|---|---|
| ***B65D 83/30*** | (2006.01) |
| ***B65D 83/20*** | (2006.01) |
| *B05B 3/02* | (2006.01) |

(52) U.S. Cl.

CPC ..... *B65D 83/201* (2013.01); *B65D 83/207* (2013.01); *B65D 83/303* (2013.01); *A45D 2200/057* (2013.01); *A45D 2200/1081* (2013.01); *B05B 3/025* (2013.01); *B65D 83/205* (2013.01)

(58) Field of Classification Search

CPC ..... A45D 2200/057; A45D 2200/1081; B65D 83/201; B65D 83/205; B65D 83/207; B65D 83/303; B05B 3/00–3/18; B05B 12/00–12/149

USPC ..... 239/337, 375, 525, 532

See application file for complete search history.

(56) References Cited

U.S. PATENT DOCUMENTS

| | | | | |
|---|---|---|---|---|
| 3,116,856 | A * | 1/1964 | Prussin et al. | 222/402.24 |
| 5,529,226 | A * | 6/1996 | Alberth, Jr. | 222/402.1 |
| 6,269,821 | B1 * | 8/2001 | Berke et al. | 132/317 |
| 6,824,025 | B1 * | 11/2004 | Ruble et al. | 222/527 |
| 2008/0073384 | A1 * | 3/2008 | Lin | 222/533 |

* cited by examiner

*Primary Examiner* — Arthur O Hall
*Assistant Examiner* — Juan C Barrera
(74) *Attorney, Agent, or Firm* — Gottlieb, Rackman & Reisman, P.C.

(57) ABSTRACT

An apparatus for delivering liquid includes a wand with a nozzle, a toggle switch, and a supply canister for delivering self-tanning and sun-tanning solutions to a human body. The wand may pivotably attach to a cap attached to the supply canister containing the chosen liquid to be delivered without the necessity of an exposed external tube suspended between the wand and the supply canister.

6 Claims, 10 Drawing Sheets

SPRAY DEVICE

This application claims priority to provisional application 61/322,786 filed Apr. 9, 2010

BACKGROUND OF THE INVENTION

The present invention generally relates to apparatus and methods for the delivery of liquid, and more specifically, to the delivery of spray tanning solutions by self-application.

With an increasing concern for health and safety, the advent of sunless tanning sprays has proven to be a significant advantage. However, the use of regular spray nozzles do not provide even application of the solution, nor do they facilitate the application of the solution on harder to reach places, particularly in cases of self-application.

In many other applications, pressurized spray devices provide more even application, but are cumbersome with the interference of long tubes used to convey the solution to the applicator or motors to provide pressurization. In many instances, the containers containing the tanning solution are separate from the applicator, therefore restricting the ability to move or ideally position the applicator, particularly during self-application. Likewise, the nozzles or applicators which provide a stream of tanning solution may be difficult to manage.

For example, one portable spray device as described in U.S. Patent Application No. US2004/0050962 A1 utilizes a cylindrical metal canister, similar to a propane tank, containing a propellant and a liquid. A long tube extends from the canister to a sprayer. The pressure allows nozzles in the sprayer to provide fluid in the form of a steady mist. The large size of the canister that encloses the propellant and liquid dictates that the device remain stationary on the ground. Therefore, only the nozzles may be easily manipulated.

U.S. Pat. No. 4,407,124 provides another example of a spray system wherein several reservoirs resembling aerosol canisters contain a liquid, and the reservoirs are held in pouches fixed on a belt of the user. A long coiled hose extends from a valve on the reservoir being used to a nozzle for spraying. Although the spray system is portable, the necessity of the pouch and belt may limit the user's maneuverability.

As further example of existing spray devices U.S. Patent Application No. US 2004/0251272 A1 presents a sunless tanning spray dispenser which includes a rigid outer canister having a valve and a nozzle. A tanning solution and a propellant are housed in the canister which resembles a common aerosol can. Unlike the previous examples, this spray device is unencumbered with long tubes or hoses or a stationary source of liquid. However, the user is limited to spraying only to the immediate vicinity of the canister. Therefore, should the user wish to achieve an even application to both the front and back of the body, the user may have difficulty in reaching certain areas of the back.

As can be seen, there is a need for an improved apparatus and method that can facilitate the application of a solution to various locations on the body while maintaining a steady stream of solution for an even application.

SUMMARY OF THE INVENTION

In one aspect of the present invention, an apparatus for delivering liquid comprises an aerosol supply canister adapted to contain the liquid; a canister cap attached to the aerosol supply canister; a wand pivotably attached to the canister cap; a trigger adapted to release the liquid in the aerosol supply canister; and a tube to carry the liquid to a spray nozzle at a distal end of the wand.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention provides apparatus and methods for delivering and applying liquids, such as to a human body. For example, the liquids delivered may be suntan lotion, sunscreen, sun-block, self-tanning solution, bronzing liquid, moisturizing lotions, special body sprays, and the like. In particular, the present invention may be used to facilitate self-application of the liquids, as the size and lightweight construction of the delivery device of the present invention enable a user to easily reach various locations on the body.

Unlike the prior art which utilizes a nozzle attached to a long intermediate tube joined to a canister, the present invention incorporates a nozzle and a pressurized supply canister into an integrated, portable spray device while maintaining a distance between the nozzle and supply canister so as to facilitate access to areas which may be difficult to reach. As such, in situations where the user would like to spray her back, the user may hold the wand in an inverted position over her shoulder, and direct it toward her back, thereby reaching areas she might not be able to access with a short nozzle.

The present invention may also eliminate the need for a lengthy exposed intermediate tube between the supply canister and the nozzle. The conventional air-brushing type of liquid delivery systems rely on a short spray gun or nozzle that is typically connected to a supply of compressed air via a lengthy exposed intermediate tube external to the spray gun. Often, the lengthy tube will hang suspended between the spray gun and the canister. An embodiment of the present invention uses a supply canister for holding liquid at a location remote from a nozzle location. A wand, which contains a tube within, has a nozzle at one end and is connected to the aerosol supply canister. Thus, the nozzle may be manipulated to spray the body at various angles and levels without the interference of external tubes.

Figure 1:
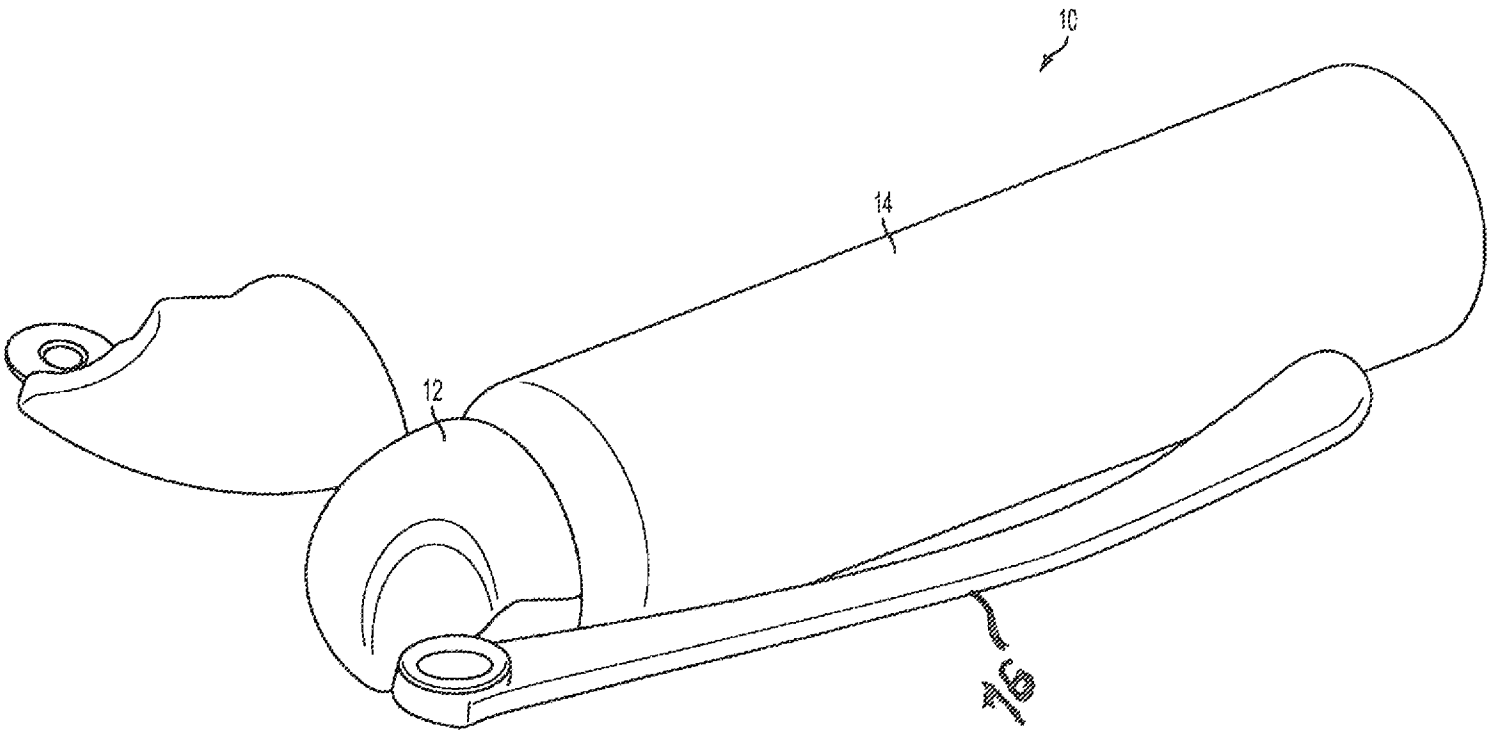
FIG. 1 is a perspective view of the delivery device according to an embodiment of the present invention, with a top cover opened.

FIG. 1 is perspective view of a spray device 10 having a canister cap 12 in an open position. The device 10 may include a supply canister 14 and a wand 16. The supply canister 14 may contain a liquid, such as a self tanning spray, to be delivered by the device 10. The liquid may be pressurized within the supply canister 14. The wand 16 may be pivotably attached to the canister cap 12, as discussed in greater detail below.

Figure 2:
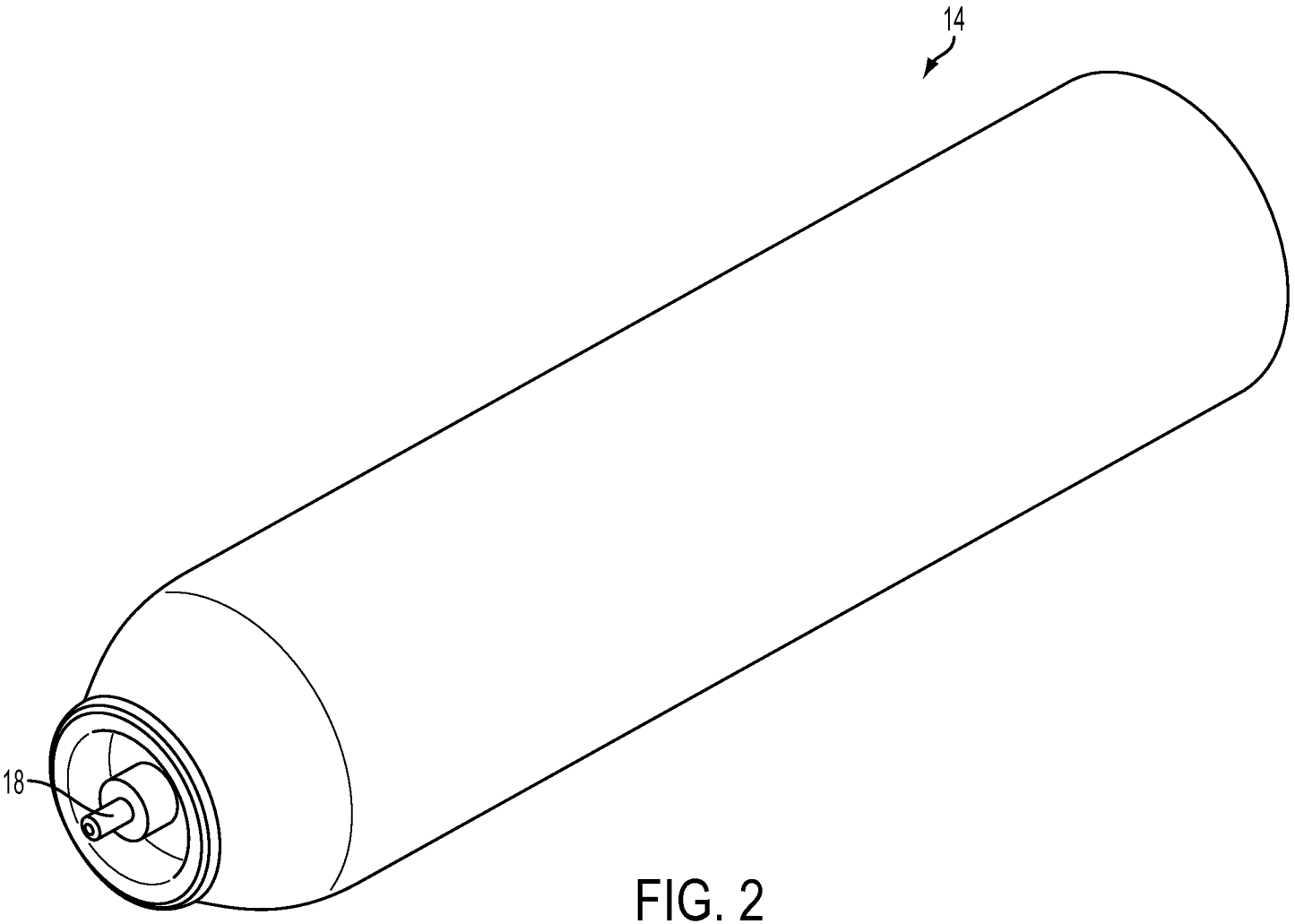
FIG. 2 is a perspective view of a canister of the device of FIG. 1.

FIG. 2 shows a perspective view of the canister 14. The canister 14 may have a canister valve 18. In one embodiment, the canister valve 18 may release liquid from in side the canister 14 by pressing the valve 18 inward toward the body of the canister 14.

Figure 3:
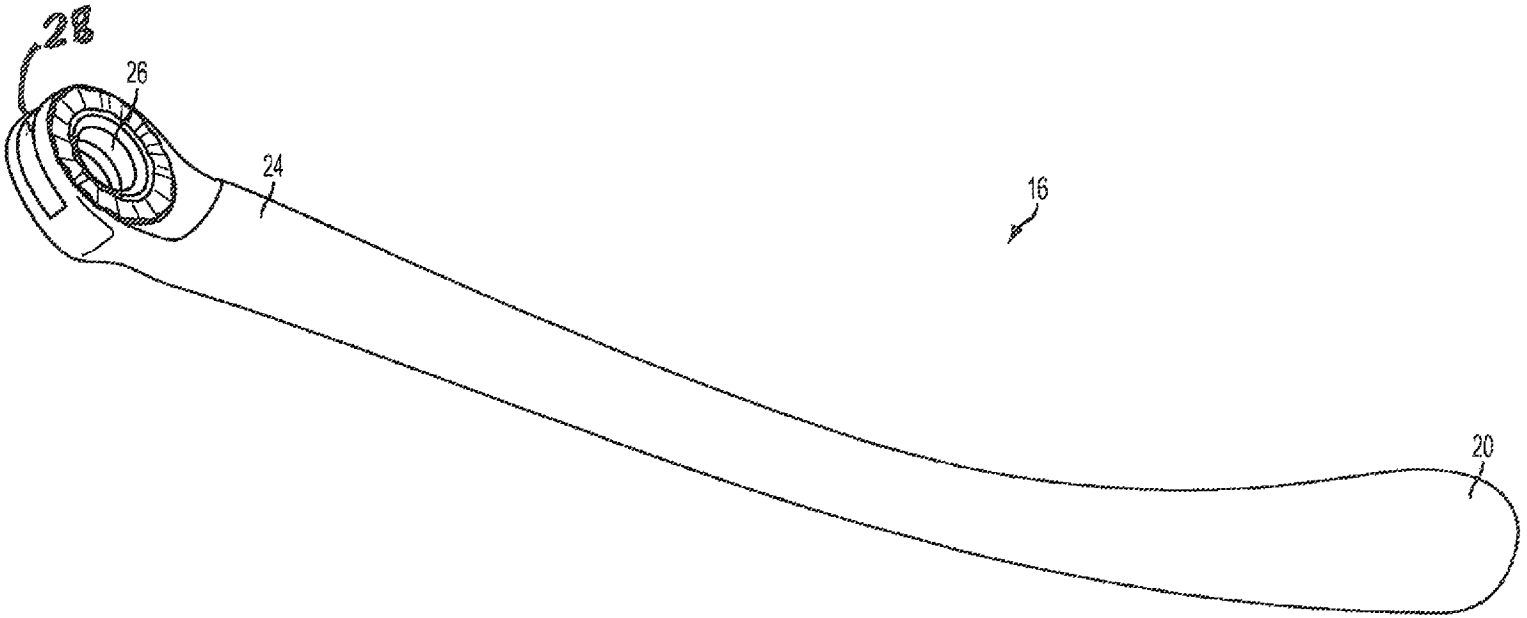
FIG. 3 is a perspective view of a sprayer wand of the device of FIG. 1.

FIG. 3 shows a perspective view of the wand 16. A distal end 20 of the wand may include a spray nozzle 22 (see FIG. 6). A proximal end 24 of the wand may include a through hole 26. The through hole 26 may allow for the wand 16 to be pivotably attached to the canister cap 12. A slot 28 in the proximal end 24 may permit a tube 30 (see FIG. 4) to span from within the canister cap 12 to the distal end 20 of the wand 16.

Figure 4:
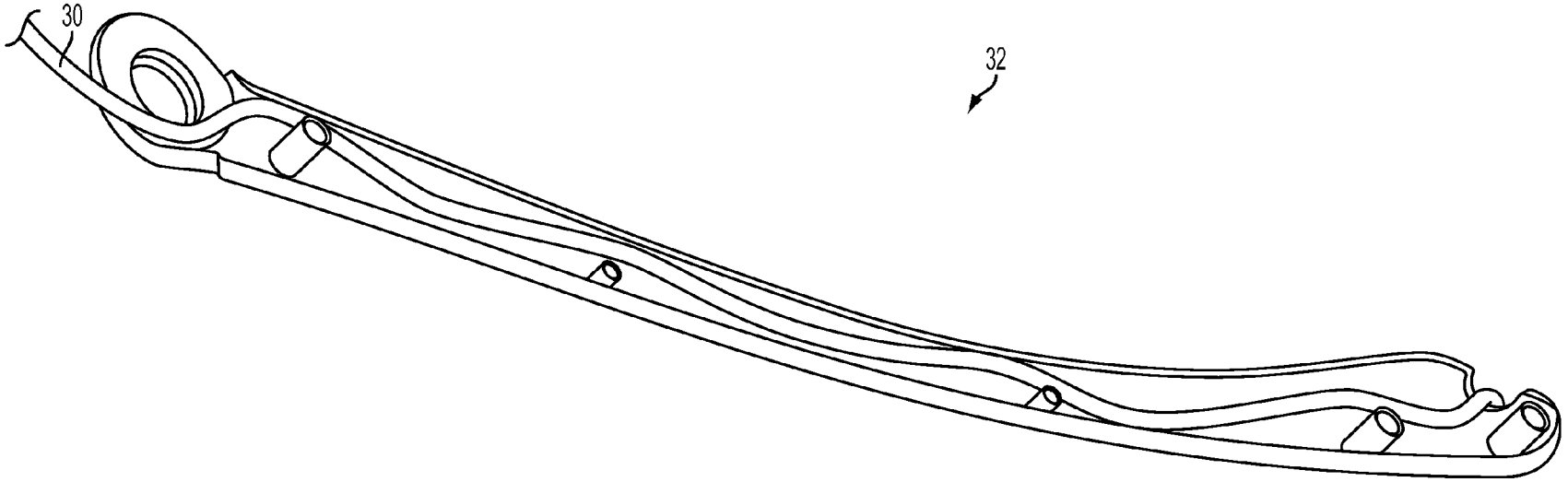
FIG. 4 is a perspective view of a right-hand half of the sprayer wand of FIG. 3.
Figure 5:
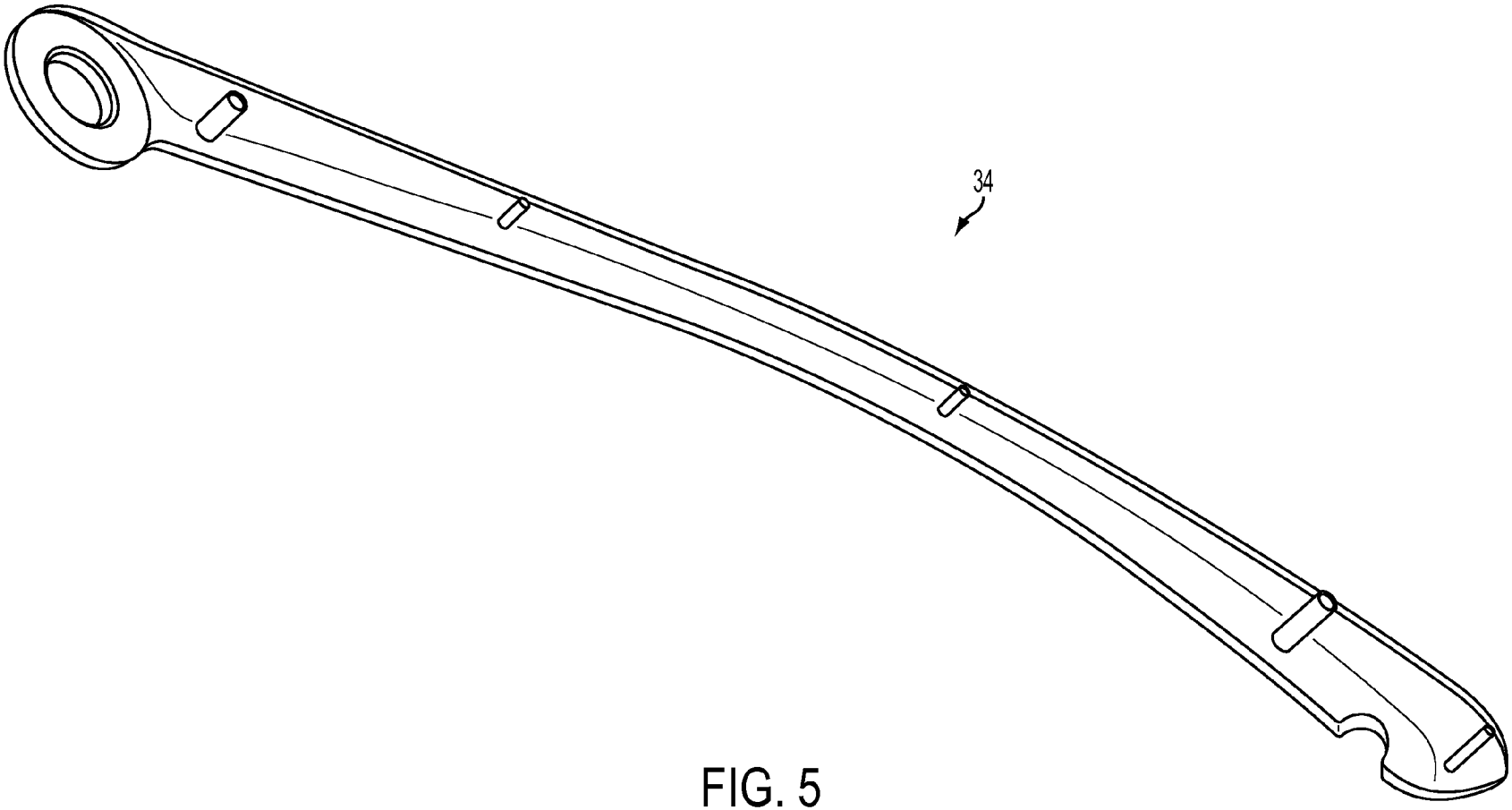
FIG. 5 is a perspective view of a left-hand half of the sprayer wand of FIG. 3.

FIGS. 4 and 5 show a right-hand half 32 and a left-hand half 34 of the wand 16. The tube 30 may be a continuous length of flexible tubing that may span the length of the wand 16.

Figure 6:
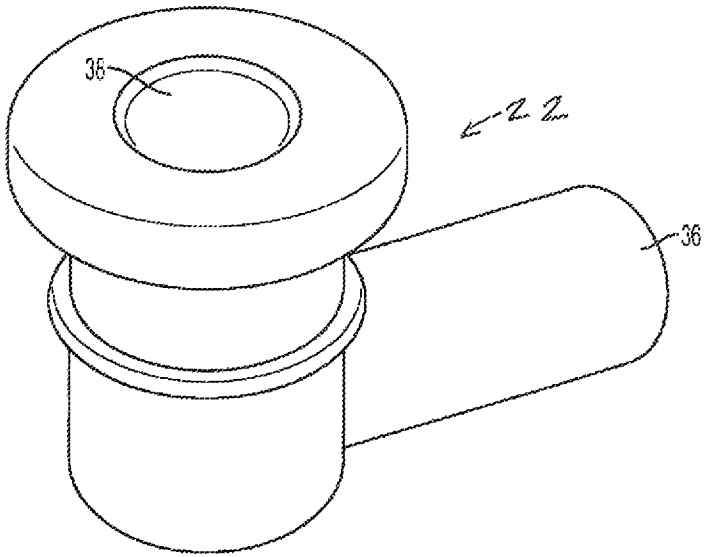
FIG. 6 is a perspective view of an exemplary embodiment of a sprayer tip of the device of FIG. 1.

The tube 30 may connect to a tube connection end 36 of the spray nozzle 22, as shown in FIG. 6. The spray nozzle 22 may include a spray outlet 38 for delivering the liquid in the canister 14 onto an object, such as a person.

Figure 7:
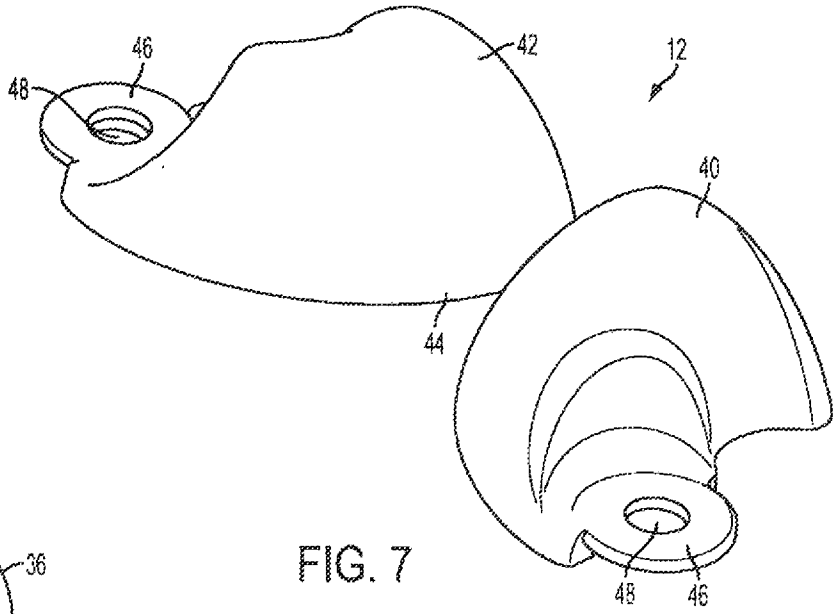
FIG. 7 is a perspective view of an opened canister cap of the device of FIG. 1.

The canister cap 12, as shown in FIG. 7, may include, in one embodiment of the present invention, a first half 40 and a second half 42 that may be joined together by a living hinge 44. Each half 40, 42 may include a wand attachment member 46. Each wand attachment member 46 may be formed integrally with the canister cap 12 and may include a through hole 48. The wand attachment members 46 may sandwich the proximal end 24 of the wand 16. The through holes 48 may align with the through hole 26 of the wand 16.

Figure 8:
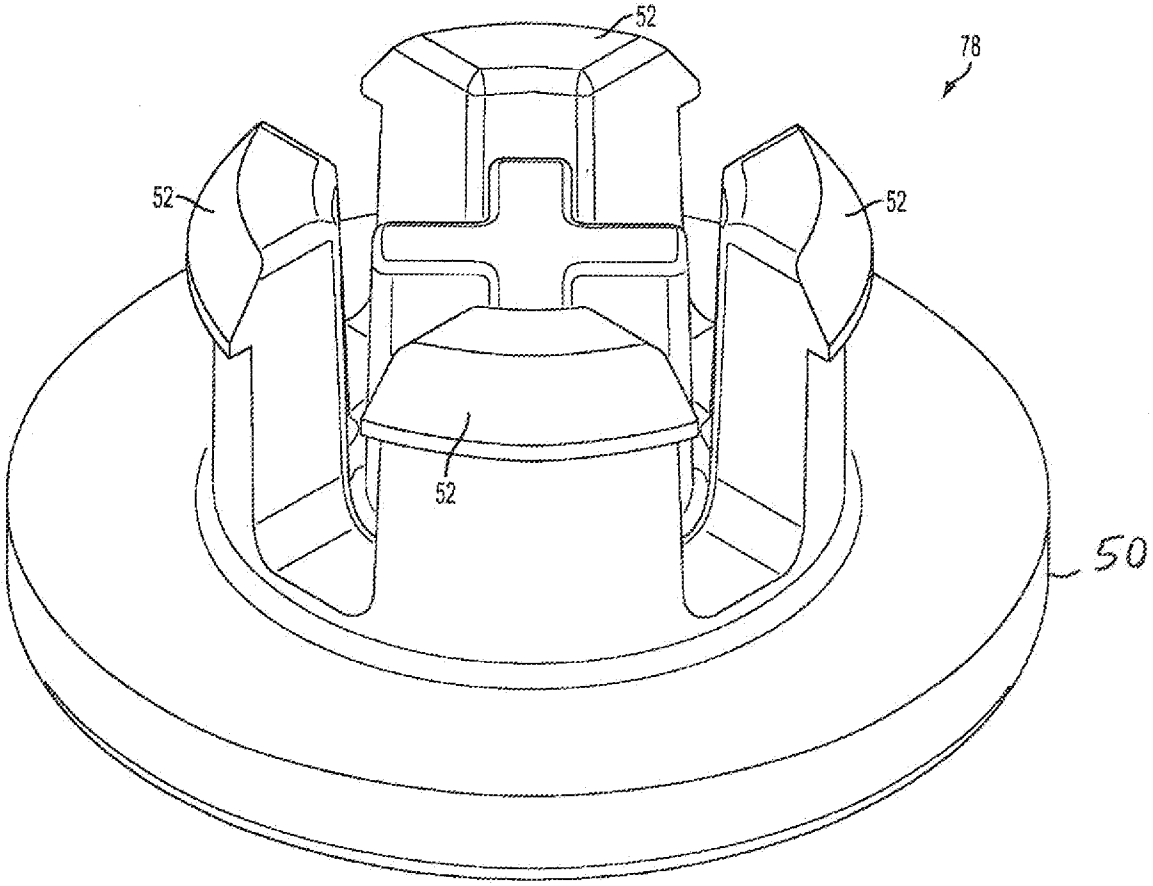
FIG. 8 is a perspective view of a button to pivotably connect the sprayer wand of FIG. 3 with the canister cap of FIG. 7.

In one embodiment of the present invention, a button member 50, as shown in FIG. 8, may be used to secure the wand 16 to the canister cap 12. The button member 50 may be inserted into through hole 48 of one half 40 of the canister cap 12. The button member 50 may pass within through hole 26 of the wand 16 and then exit out of through hole 48 of the other half 42 of the canister cap 12. Tabs 52 of the button member 50 may prevent removal of the button member 50 once inserted to pivotably retain the wand 16 to the canister cap 12.

Figure 9:
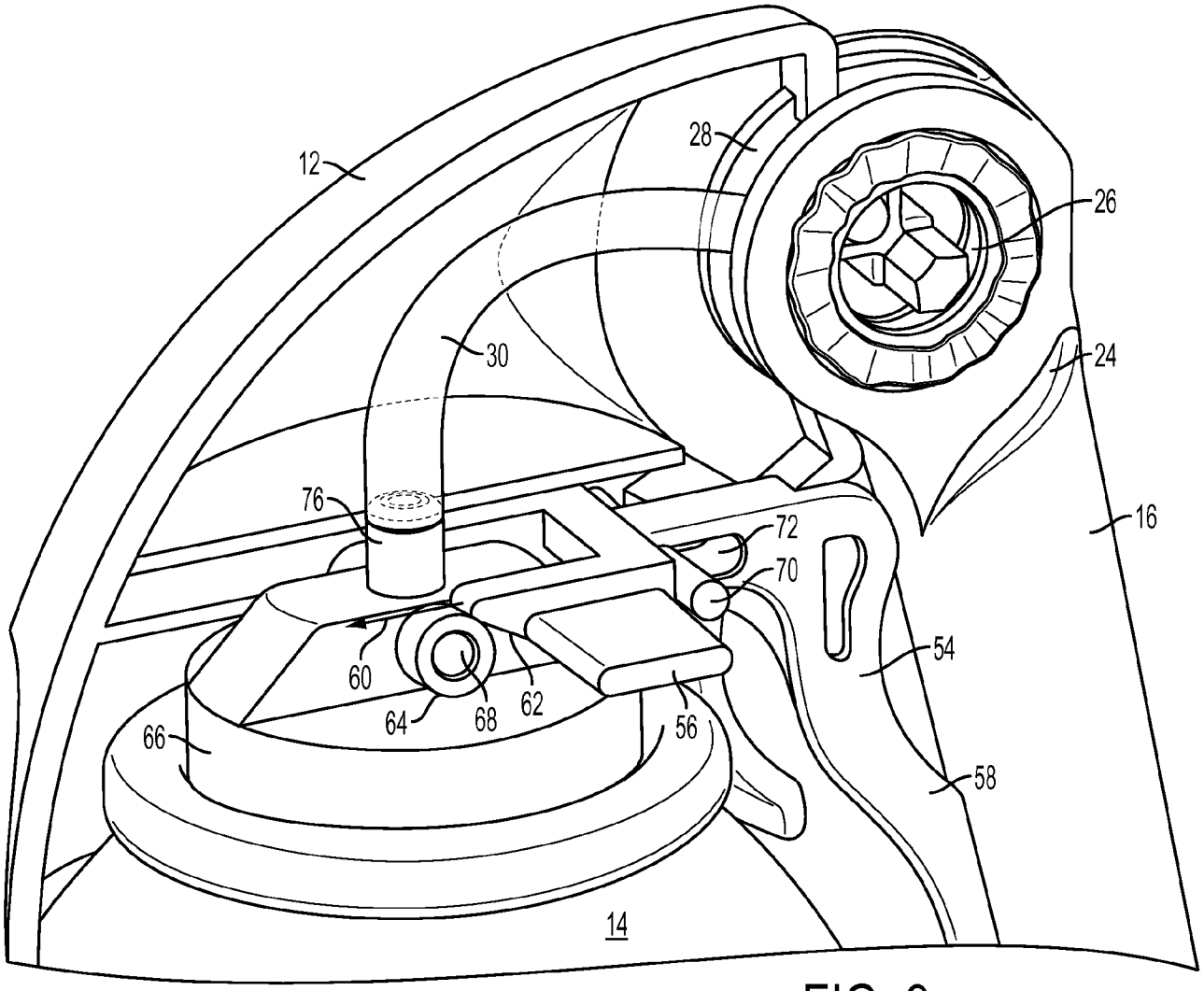
FIG. 9 is a perspective view of the device of FIG. 1 with a portion of the canister cap removed.
Figure 10:
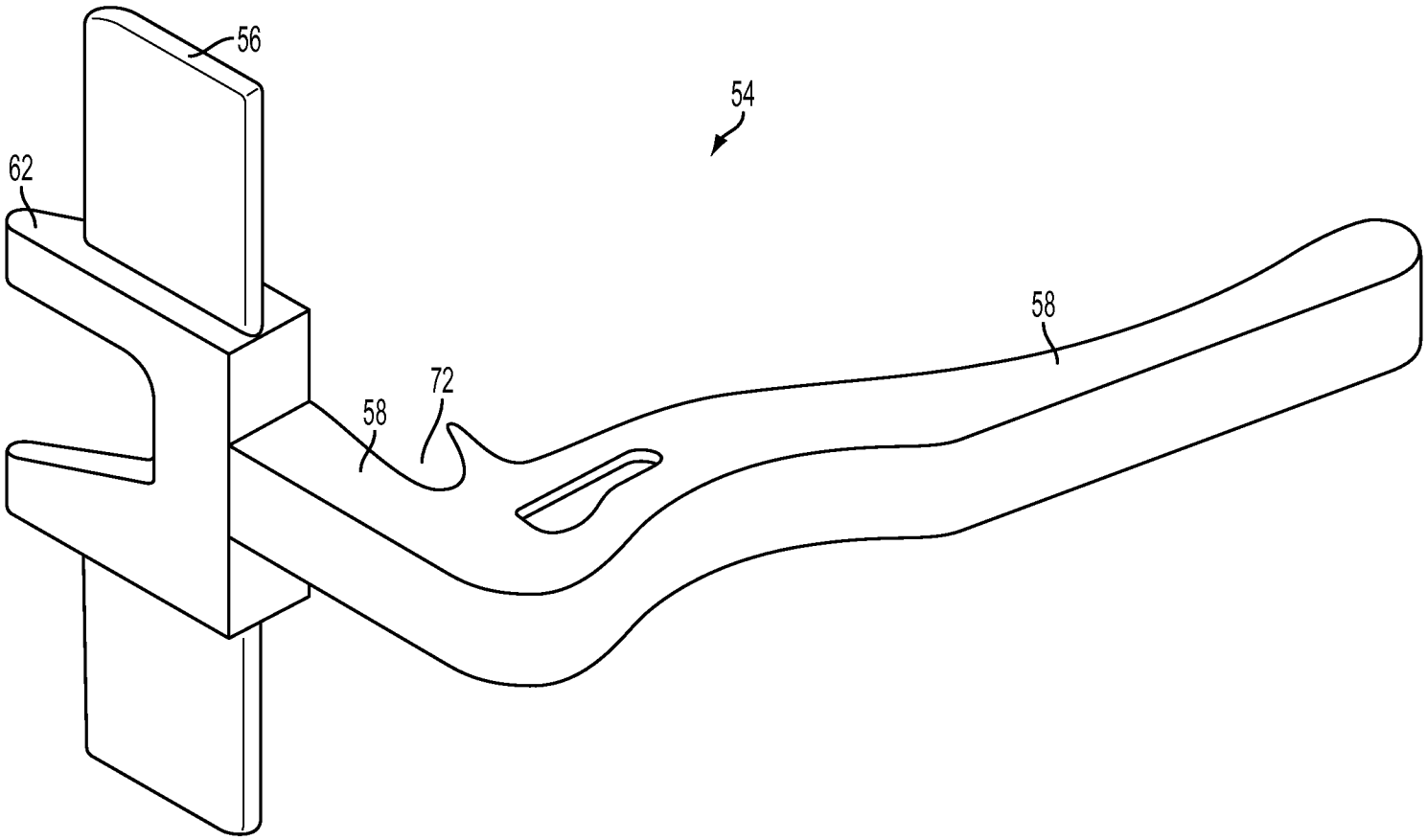
FIG. 10 is a perspective view of a trigger of the device of FIG. 1.
Figure 11:
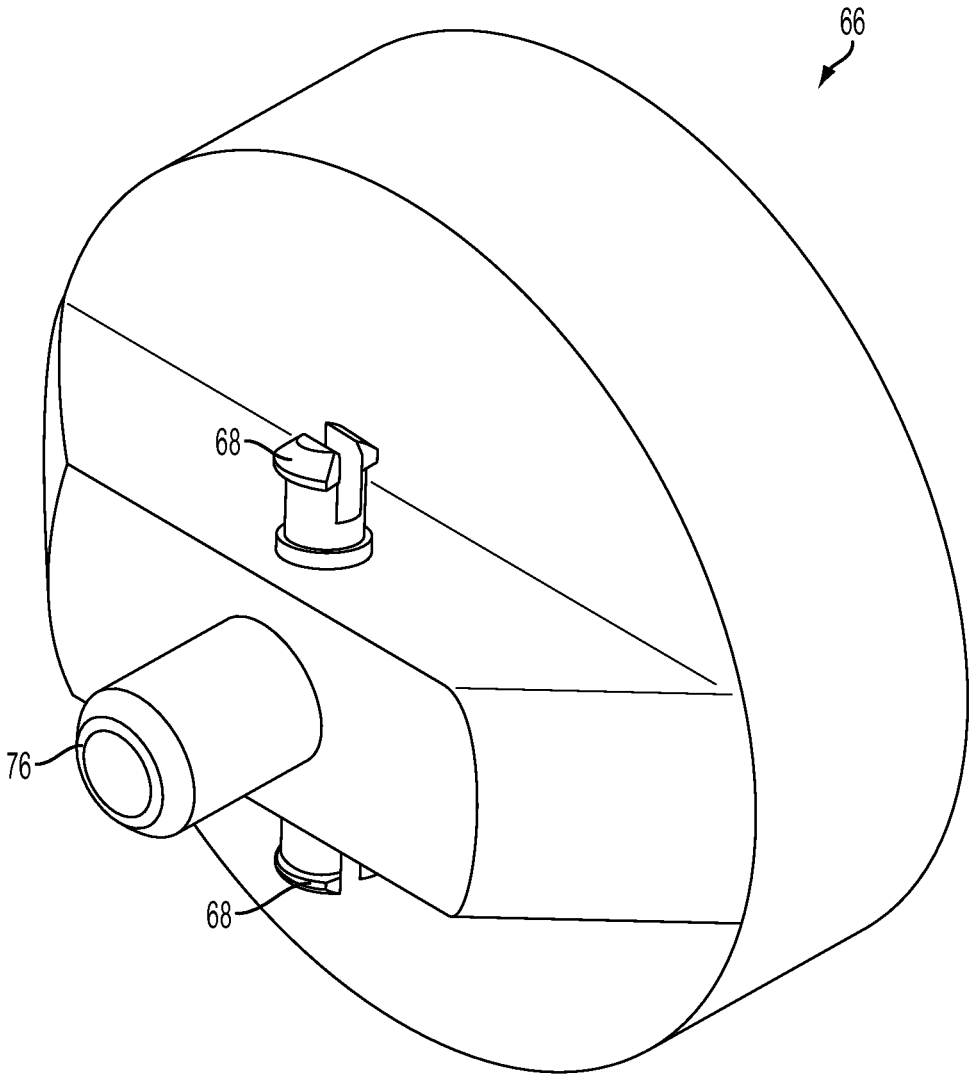
FIG. 11 is a perspective view of a valve coupler of the device of FIG. 1

Referring to FIGS. 9 through 11, a trigger 54 may be disposed with a triggering end 56 disposed within the canister cap 12 and a trigger end 58 extending outwardly from the canister cap 12. The trigger end 58 may be squeezed by the user, as discussed below, to release the liquid from the canister 14.

The triggering end 56 may move substantially in the direction of arrow 60 when a user squeezes the trigger end 58 of the trigger 54. A sloped surface 62 of the triggering end 56 may depress rollers 64 disposed on each end of a valve coupler 66. This depression may cause the valve coupler 66 to move toward the body of the canister 14, causing the liquid in the canister 14 to be released from a valve coupler male fitting 76. The valve coupler male fitting 76 may attach to the tube 30 that extends through the wand 16. The rollers 64 may attach to roller pins 68.

The trigger 54 may be further secured to the canister cap 12 with a pin 70. A slot 72 may be disposed within the trigger 54 to allow movement of the trigger 54 in the direction of arrow 60 while limiting movement of the trigger in other directions.

To use the device 10 of the present invention, a user may pivot the wand 16 at a desired angle relative to the canister 14. The user may then depress the trigger 54 which may cause the sloped surfaces 62 of the trigger 54 to depress the valve coupler 66. This may cause liquid in the canister 14 to be released from the coupler male fitting 76, through the tube 30 and out through the spray nozzle 78.

It should be understood, of course, that the foregoing relates to exemplary embodiments of the invention and that modifications may be made without departing from the spirit and scope of the invention as set forth in the following claims.

What is claimed is:

1. An apparatus for delivering liquid, comprising:

a supply canister adapted to contain the liquid;

a canister cap attached to the supply canister;

a hinging mechanism;

a wand having a proximal wand end and a distal wand end, the proximal wand end attached to the canister cap by said hinging mechanism to allow said wand to be selectively pivoted with respect to said canister cap, said wand defining a chamber extending longitudinally through said wand;

an actuator adapted to release the liquid in the supply canister; and a tube extending through said chamber and said hinging mechanism and having a proximal tube end operationally connected to said actuator and a distal tube end disposed at said distal wand end to carry the liquid to at said distal wand end.

2. The apparatus of claim 1, wherein the wand further comprises: a nozzle attached to said tube at said distal wand end for spraying the liquid toward a desired location.

3. The apparatus of claim 1, wherein the wand includes a tube opening, and the tube extends from the tube opening to the nozzle.

4. The apparatus of claim 3, wherein the tube opening is located on the proximal end of the wand.

5. The apparatus of claim 1, wherein the actuator includes a trigger switch located on the canister cap to release or stop the flow of liquid from the canister to the nozzle.

6. The apparatus of claim 1 wherein said canister has a lateral cylindrical surface and said wand is movable between a first and a second position by said hinging member, said wand being disposed adjacent to said lateral cylindrical surface in said first position in parallel with said lateral cylindrical surface.

* * * * *